United States Patent [19]

Redman

[11] Patent Number: 4,757,703

[45] Date of Patent: Jul. 19, 1988

[54] DIE APPARATUS FOR HANDLING TUBING HAVING A RADIALLY PROJECTING ANNULAR FLANGE

[75] Inventor: Robert J. Redman, Indian River, Mich.

[73] Assignee: Tube Fab of Afton Corporation, Afton, Mich.

[21] Appl. No.: 6,809

[22] Filed: Jan. 27, 1987

[51] Int. Cl.[4] ..... B21D 41/02; B21D 22/00

[52] U.S. Cl. ..... 72/357; 72/313; 72/317; 72/422

[58] Field of Search ..... 72/308, 314, 315, 316, 72/318, 357, 361, 422, 317, 323

[56] References Cited

U.S. PATENT DOCUMENTS

| | | | |
|---|---|---|---|
| 1,955,356 | 4/1934 | Brenner | 72/313 |
| 2,193,078 | 3/1940 | Schlenk | 72/323 |
| 2,658,548 | 11/1953 | Harrison | 72/315 |
| 3,000,424 | 9/1961 | Weise . | |
| 3,059,509 | 10/1962 | Sofranko et al. | 72/314 |
| 3,292,411 | 12/1966 | Thompson | 72/314 |
| 3,415,100 | 12/1968 | Britts | 72/317 |
| 3,575,033 | 4/1971 | Meyer | 72/317 |
| 4,630,459 | 12/1986 | Elliott | 72/422 |

*Primary Examiner*—W. Donald Bray
*Attorney, Agent, or Firm*—Basile and Hanlon

[57] ABSTRACT

A die apparatus operable to form or to clamp a tube with an upset annular flange includes a pair of opposed die members mounted for horizontal movement toward and away from each other at opposite sides of a fixed path along which the tube is axially fed when the die is opened. The die members are spring biassed to their open position and driven to their closed position by a vertically reciprocable die actuator having inclined surfaces slidably engaged with the outer surfaces of the die members to wedge the die members to their closed position.

2 Claims, 1 Drawing Sheet

DIE APPARATUS FOR HANDLING TUBING HAVING A RADIALLY PROJECTING ANNULAR FLANGE

BACKGROUND OF THE INVENTION

The present invention is concerned with die apparatus which is employed to form a flange-like annular upset upon a straight length of tubing or to otherwise fixedly clamp such a length of tubing with the annular upset enclosed within the die while the length of tubing is still attached to an indeterminate length of tubing stock which is axially advanced through the die when the die is opened so that flanged tubing parts may be formed or handled by the die on a mass production basis.

Such tubing parts are employed in large numbers by the automotive industry, typically in vacuum powered systems. Conventionally, tubing from a supply coil is passed through a straightener and feeding device of well known construction to a forming die which, when closed, will fixedly clamp two axially spaced sections of the tubing between two separate die member pairs. While the tubing is so clamped, one of the die member pairs is driven axially toward the other and the resultant compression of the relatively short section between the two clamped portions of the tubing causes this section to expand radially outwardly to form an annular upset or flange on the tubing. One of the die pairs has its cavity formed with an enlarged diameter section to receive this flange. After the upset is formed, the die members are opened and the tubing is axially advanced to move the flanged section clear of the die and simultaneously bring a new tube section into the die. The flanged section may proceed directly from the die to a cutoff device, or it may be advanced to a second die which will clamp the tubing while some other work operation is performed on the flanged length of tubing.

In such an operation, the tubing is fed along a substantially fixed axial path which extends through the die. Conventionally, the separable die members are split on a horizontal plane with the lower die member held against vertical movement and the upper die member moving vertically between the die open and closed position, as by a conventional hydraulic cylinder. This arrangement enables the semi-circular cross-sectioned tube receiving recess in the lower die member to serve as a tube guide.

In order to perform the upsetting of the tube which creates the annular flange-like upset, the two sections of the tube which are gripped by the dies must be clamped very firmly in the die so that no slippage between the die and tube occur during the upsetting operation. Thus, hangup of the formed part in one of the die sections upon opening of the die is a frequent occurrence, and because one of the die members, namely the lower member, is fixedly mounted and the tube is typically engaged by feeding means both upstream and downstream of the die which are aligned with the recess in the lower die member, the tube typically will tend to remain seated in the lower die member upon opening of the die. Subsequent actuation of the feeding means to advance the flanged tubing axially through the die is hindered by the fact that the freshly formed flange is seated within the enlarged diameter portion of the die cavity provided to control the flange formation.

The present invention is especially directed to a die apparatus designed to minimize the foregoing problems.

SUMMARY OF THE INVENTION

In accordance with the present invention, a die adapted to clamp tubing of indeterminate length, having an upset annular flange thereon, which is to be fed axially through the die when the die is opened is formed by a pair of opposed die members mounted for horizontal movement toward and away from each other and having opposed die faces lying in parallel vertical general planes. The tube engaging portions of the die members are constituted by semi-cylindrical recesses extending horizontally across the die faces from end to end and having a relatively short enlarged diameter section conformed to the upset annular flange on the tube.

The die members are resiliently biased away from each other toward their die open position by compression springs engaged between the opposed die faces. The outer sides of the die members are formed with a plane inclined surface with the inclined surfaces at the outer sides of the opposed die members slidably received between complementary inclined surfaces of a vertically reciprocable die actuating member operable upon downward movement to drive the die members to their closed position by a wedging action.

Other objects and features of the invention will become apparent by reference to the following specification and to the drawings.

IN THE DRAWINGS

Figure 1:
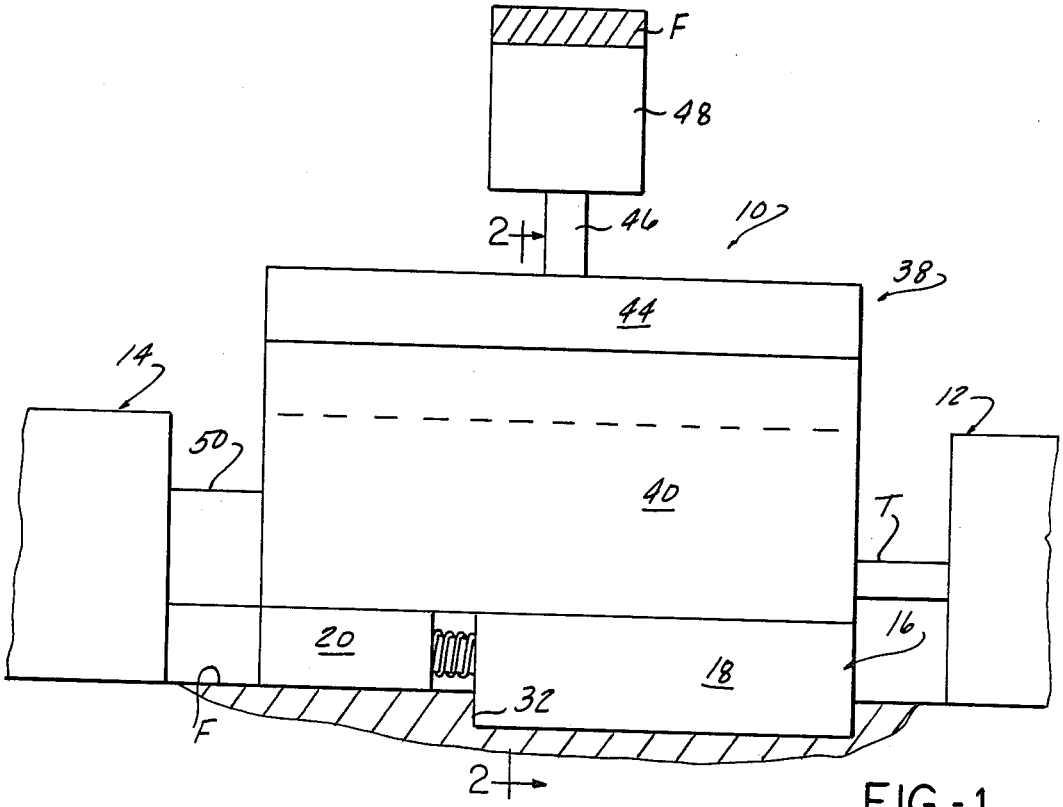
FIG. 1 is a side elevational view, with certain parts broken away or shown in section, of a die apparatus embodying the present invention.

In the drawings, the present invention is disclosed as applied to a die apparatus designated generally 10 to which tubing T of indeterminant length is axially fed in intermittent steps to form an upset annular flange F (FIG. 4) by operation of the die. The tubing T may be fed from a supply coil (not shown) through a straightener, (not shown) and a feeding device, partially indicated at 12, which feeds the tubing T, in axial intermittent step-by-step movement synchronized with the operation of the die, through die 10 to another apparatus partially indicated at 14, which may for example be a cutter which cuts the now flanged section of tubing to a predetermined length.

Figure 4:
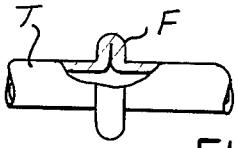
FIG. 4 is a detailed view, partially in section, with portions broken away, of an upset flange portion of a tubing formed by the apparatus of FIG. 1.
Figure 3:
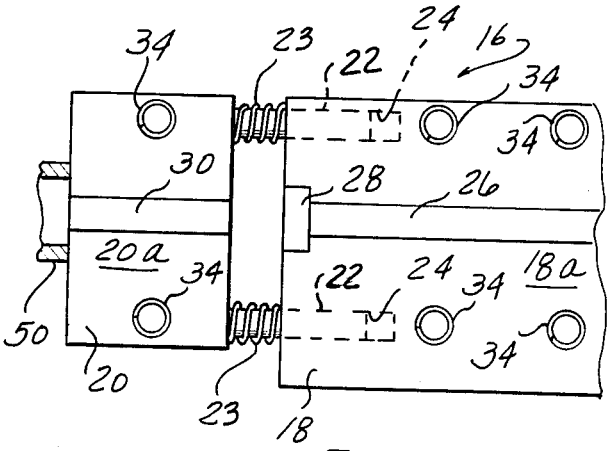
FIG. 3 is a view of one of the die faces of the apparatus of FIG. 1 taken approximately from a plane 3—3 of FIG. 2.

Die apparatus 10 includes a pair of opposed die assemblies designated generally 16 which are mirror image duplicates of each other having identical construction. Referring first to FIG. 3, each die assembly 16 includes first and second die members 18, 20 respectively with the second die member being supported and guided relative to the first die member 18 by a pair of pins 22 fixedly secured to member 20 slidably received within bores 24 formed in member 18. Compression springs 23 bias member 20 away from member 18. Members 18 and 20 are formed at their inner sides with flat vertical die faces **18*a*, 20*a* which lie in a common vertical general plane. A semi-cylindrical recess 26 having an enlarged diameter portion 28 at the end adjacent member 20 extends horizontally across die face 18***a*, and a semi-cylindrical recess 30 extends entirely across die face 20*a* in coaxial alignment with recess 26. With reference to tube T as illustrated in FIG. 4, the recesses 26 and 30 are conformed to the outer diameter of tube T so that the tube will be tightly clamped within these recesses when the opposed die members 16 are closed with their die faces in face-to-face engagement with each other. Recess 28 is conformed to enclose the upset flange F formed on tube T by the die.

Figure 2:
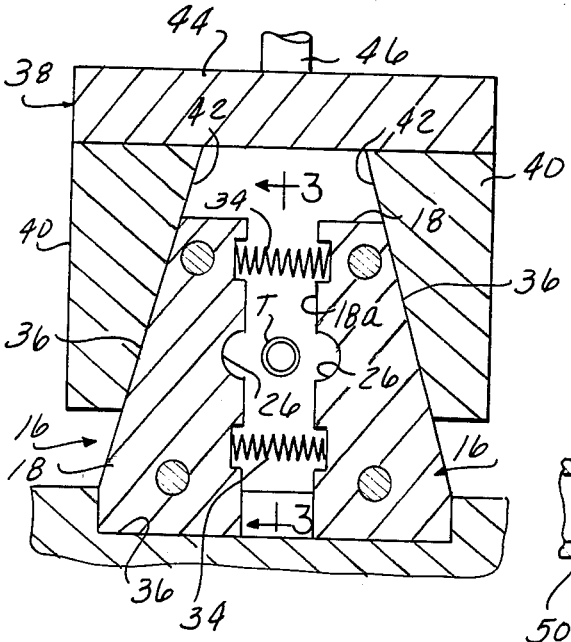
FIG. 2 is a cross-sectional view taken on line 2—2 of FIG. 1.

Referring now to FIG. 1, the first members 18 of the die assembly 16 are mounted in a fixed frame F within a transversely extending slot 32 formed in the machine frame F so that members 18 can move only toward and away from each other as viewed in FIG. 2. The second die members 20, as best seen in FIG. 1, are slidably supported upon a flat surface of frame F, and in addition to being able to move toward and away from each other with their associated die members 18, second members 20 may also move toward and away from their associated member 18 (i.e. from left to right and vice versa as viewed in FIG. 1).

Compression springs 34 (FIG. 2) are engaged between the opposed die faces of die members 16 to bias the opposed members 16 away from each other to a die opened position shown in FIG. 2.

As best seen in FIG. 2, the outer side surfaces of each of die members 16 are formed with symmetrical upwardly and inwardly inclined plane surfaces 36. A rigid data actuating member designated generally 38 includes a pair of downwardly projecting legs 40 formed with inclined inner surfaces 42 complementary to and slidably received upon the inclined outer surfaces 36 of die members 16. A rigid cross frame member 44 fixedly secures legs 40 to each other.

Die actuating member 38 is fixedly attached to the piston rod 46 of a double acting hydraulic cylinder 48 fixedly secured to the machine frame F. Cylinder 48 is operable, in a well known manner, to vertically reciprocate actuating member 38 downwardly to drive the opposed die members 16 from the die opened position shown in FIG. 2 to a die closed position in which the opposed die faces are in face-to-face relationship with each other to clamp a tube T in the recesses of the die face. The inclined surfaces 42 on actuating member 38 exert a wedging action on the complementary inclined surface 36 of the die members. Upon return of the actuating member to the die open position of FIG. 2, springs 34 cause the die faces to separate from each other wherein the opposed die faces are always spaced at equal distances from the tube T which is restrained from horizontal side-to-side movement as viewed in FIG. 2 by feeding devices in the units 12 and 14 (FIG. 1) located upstream and downstream of the die apparatus.

Operation of the apparatus described above is as follows.

With die assembly 10 in its open position, tubing T is fed from right to left as viewed in FIG. 1 by the feeding device 12 through die assembly 10 and into cutter 14. The tubing is stopped when a predetermined length of tubing projects beyond die apparatus 10, dependent upon the length of the part to be formed. Normally, the leading end of the tube T will be gripped, at this time, by a feed or guide mechanism in cutter 14. The tubing T moves along a fixed path coaxial with the tubing axis and is restrained against movement laterally from this path by feeding and guiding apparatus in units 12 and 14.

When the tubing is axially positioned relative to die apparatus 10, cylinder 48 is actuated to drive die actuator 38 down, closing the die and firmly clamping tubing T within recesses 26 and 30 of the two positions of die assembly 16. At this time, the die element 20 (FIG. 3) is spaced forwardly from its associated die element 18, as illustrated in FIG. 3. Thus, the tubing T is clamped at two axially spaced locations, one between recesses 26 of the opposed die members and a second between accesses 30 of die members 20.

Die members 20 are then driven axially of the tubing toward their associated die members 18. The unclamped tubing between the two die members is thus compressed and expands radially outwardly into the recesses 28 in die members 18 to form the flange F as shown in FIG. 4.

The driving of closed die members 20 in the axial direction to upset the flange F may be accomplished by any of several mechanisms well known to those skilled in the art. One form of mechanism might consist of a hollow piston rod 50 (FIG. 3) actuated by a cylinder located within the cutter element, the piston rod 50 projecting from both ends of the cylinder so that the tube could pass freely axially through the piston and cylinder rod see, for example, U.S. Pat. No. 4,235,137 disclosing such an arrangement employed in a tube cutoff device.

Cylinder 48 is then actuated to raise actuator 38 to enable springs 34 to open the die members. Tubing T stays centrally between the opening die members. The retraction of the die members from the tubing in its open position is greater than the projecting radius of flange F, thus when the dies are fully opened the tube can be advanced axially without casing the projecting flange to engage the dies.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. In a die apparatus including separable die members operable in a die closed position to define an elongate cavity extending entirely through said die members from end to end, said cavity having a uniform first diameter over a major portion of its length and at least one coaxial enlarged diameter section intermediate the ends of said cavity whereby said cavity is conformed to tightly clamp an elongate length of tubing having a flange-like annular upset thereon, when said die members are in the closed position, and means for feeding tubing axially along a fixed path through said die members when said die members are separated from each other in a die open position;

the improvement wherein said die apparatus comprises a pair of die members mounted for traverse horizontally coordinated movement toward and away from each other between a traversely spaced open position and a first die closed position, each of said pair of die members having first and second die parts mounted for longitudinal horizontally coordinated movement toward and away from each other between a longitudinally spaced open position and a second die closed position, said first and second die parts having opposed die faces at inner sides lying in parallel vertical general planes traverse to said fixed path, guide pin and spring means engaged between said first and second die parts resiliently guiding and biasing said first and second die parts to the longitudinally spaced open position, wherein said first die parts are retracted longitudinally along said fixed path from said second die parts, said pair of die members having opposed die faces at inner sides lying in longitudinally parallel vertical general planes with respect to said fixed path and horizontally extending tube receiving recesses extending across said die faces cooperable to fixedly clamp a continuous length of tubing between said first and second parts of said pair of die members when said pair of die members are in the first die closed position, spring means engaged between said pair of die members resiliently biasing said pair of die members to the traversely spaced open position wherein said die faces are retracted at equal distances traversely from said fixed path exceeding the radial outward projection of said annular upset, means for advancing said continuous length of tubing, by a predetermined length, axially along said fixed path through said die members wherein a new length of tubing is positioned between said pair of die members, first power actuated means for driving said pair of die members simultaneously from the traversely spaced open position to the first die closed position, and second power actuated means for driving said first die parts simultaneously from the longitudinally spaced open position to the second die closed position to form the annular upset at a selected point along the longitudinal length of said tubing between said first and second die parts of said pair of die members.

2. The invention defined in claim 1 wherein said power actuated means comprises means at the outer sides of said pair of die members defining symmetrically upwardly, inwardly, and continuously inclined plane surfaces, a rigid actuating member spaced above said pair of die members and including a pair of downwardly projecting legs having plane inclined surfaces complementary to and slidably engaged with said inclined surfaces on said pair of die members, and power means for raising and lowering said rigid member.

* * * * *